United States Patent [19]

Thauer

[11] 4,299,327

[45] Nov. 10, 1981

[54] PLACEMAT RACK

[75] Inventor: William R. Thauer, Centerville, Mass.

[73] Assignee: General Housewares Corp., Hyannis, Mass.

[21] Appl. No.: 101,451

[22] Filed: Dec. 10, 1979

[51] Int. Cl.[3] ..... A47F 5/01

[52] U.S. Cl. ..... 211/186; 211/133; 211/181

[58] Field of Search ..... 211/186, 181, 45, 133, 211/49 D, 189, 163, 144

[56] References Cited

U.S. PATENT DOCUMENTS

| | | | |
|---|---|---|---|
| 2,793,760 | 5/1957 | Zel et al. | 211/181 X |
| 3,085,694 | 4/1963 | Jones | 211/181 X |
| 3,243,047 | 3/1966 | Witteborg | 211/163 X |
| 3,276,400 | 10/1966 | Brunette | 211/187 X |
| 3,537,596 | 11/1970 | Brunette | 211/186 |
| 3,680,712 | 8/1972 | Surasek | 211/181 |
| 4,197,950 | 4/1980 | Ovitz | 211/45 X |

*Primary Examiner*—Roy D. Frazier
*Assistant Examiner*—Robert W. Gibson, Jr.
*Attorney, Agent, or Firm*—Wolf, Greenfield & Sacks

[57] ABSTRACT

A placemat rack has a plurality of wire sections with a first section having a series of vertically spaced placemat shelves for holding a stack of placemats in extended unfolded positions for viewing from a first facing plane. Each of the shelves are arranged at an angle to a vertical axis of the rack and slant downwardly from the back to the front of each section. An upwardly extending web is provided at the front of each shelf for supporting edges of the placemat. Vertically extending end members are provided at sides of a first section of shelves and provide a means for mounting an advertising display. Back to back wire sections provide for viewing of placemats at two opposed vertical planes while spaced side sections face outwardly to provide viewing at planes opposed to each other and substantially perpendicular to the first-mentioned viewing planes.

2 Claims, 4 Drawing Figures

16a
31a
12
16b
21b
52
16c
40
46
49
50
13
14
49
41
53
15b
23a
11
23
15c
15
32
16
31
33

PLACEMAT RACK

BACKGROUND OF THE INVENTION

There are particular problems associated with the display and sale of placemats in an esthetically pleasing manner and in a manner which also minimizes floor area required for display in sales locations. A variety of display racks have been used in the past. Often placemats are packaged in folded condition in order to minimize the display area required. However, compact folding of placemats can often result in some inhibition of sales since the consumer cannot fully view the article to be purchased. Flat full exposure display of placemats is preferred.

SUMMARY OF THE INVENTION

It is an important object of this invention to provide a placemat rack for maximizing esthetically pleasing display of a large number of placemats in a minimized floor area.

It is another object of this invention to provide a placemat rack in accordance with the preceding object which can be formed of sections which provide a number of viewing planes and a number of separately visible stacks of placemats in a minimized floor area utilizing conventional wire rack construction techniques.

It is still another object of this invention to provide a placemat rack in accordance with the preceding objects which can be formed of wire and provided with decorative advertising display areas at corners thereof to maximize esthetic appearance and commercial message transmittal to the buying public.

According to the invention, a placemat rack for maximizing esthetically pleasing display of a large number of placemats in a minimized floor area is provided. The rack comprises a first wire section defining a series of placemat shelves for holding a stack of placemats with each placemat in extended unfolded position for viewing from a first facing plane. Each of the shelves are arranged at an angle to a vertical axis of the rack and slant downward from the back to the front of the rack first section with the shelves being stacked in a vertical row, one above the other and providing a plurality of side to side extending display areas having a side to side length of at least 16 inches and a front to back width of at least 10 inches. A second wire rack section carries similar placemat shelves connected with the first section and providing for placemat display and viewing along a second facing plane different than the first plane. Preferably, vertically extending end members are at each side of a plurality of sections and define side edges of that plurality of sections to provide means for mounting advertising displays. Preferably, the shelves are attached only at the rear to the rack and have free forward ends. In the preferred embodiment, the racks provide viewing from a square or rectangular area defining four facing planes within two pairs with the planes of each pair opposed to each other.

It is a feature of this invention that each shelf is wide enough to allow full display of a conventional placemat. It is another feature of this invention that the racks provide shelves spaced apart vertically from each other a distance such that when matched with the angle of the shelves, substantial viewing of the full width of placemats placed thereon is possible. Since the rack is sectional, the sections can be arranged to cover substantially the full area enclosed within the outer periphery of any arrangement of the sections. Thus, in a rectangular or square configuration of the rack, a top view would show substantially all of the area covered by a placemat display. Preferably, the lower outer end of each shelf is free with the attachment of the shelves at a rear edge only. Thus, each shelf is somewhat resilient and if accidentally struck by the hand of a customer in handling the display merchandise, tends to give rather than severely harm the hand.

DESCRIPTION OF THE DRAWINGS

The above and other objects, advantages and features of the present invention will be better understood from a reading of the following specification in conjunction with the accompanying drawing in which.

BRIEF DESCRIPTION OF PREFERRED EMBODIMENTS

Figure 1:
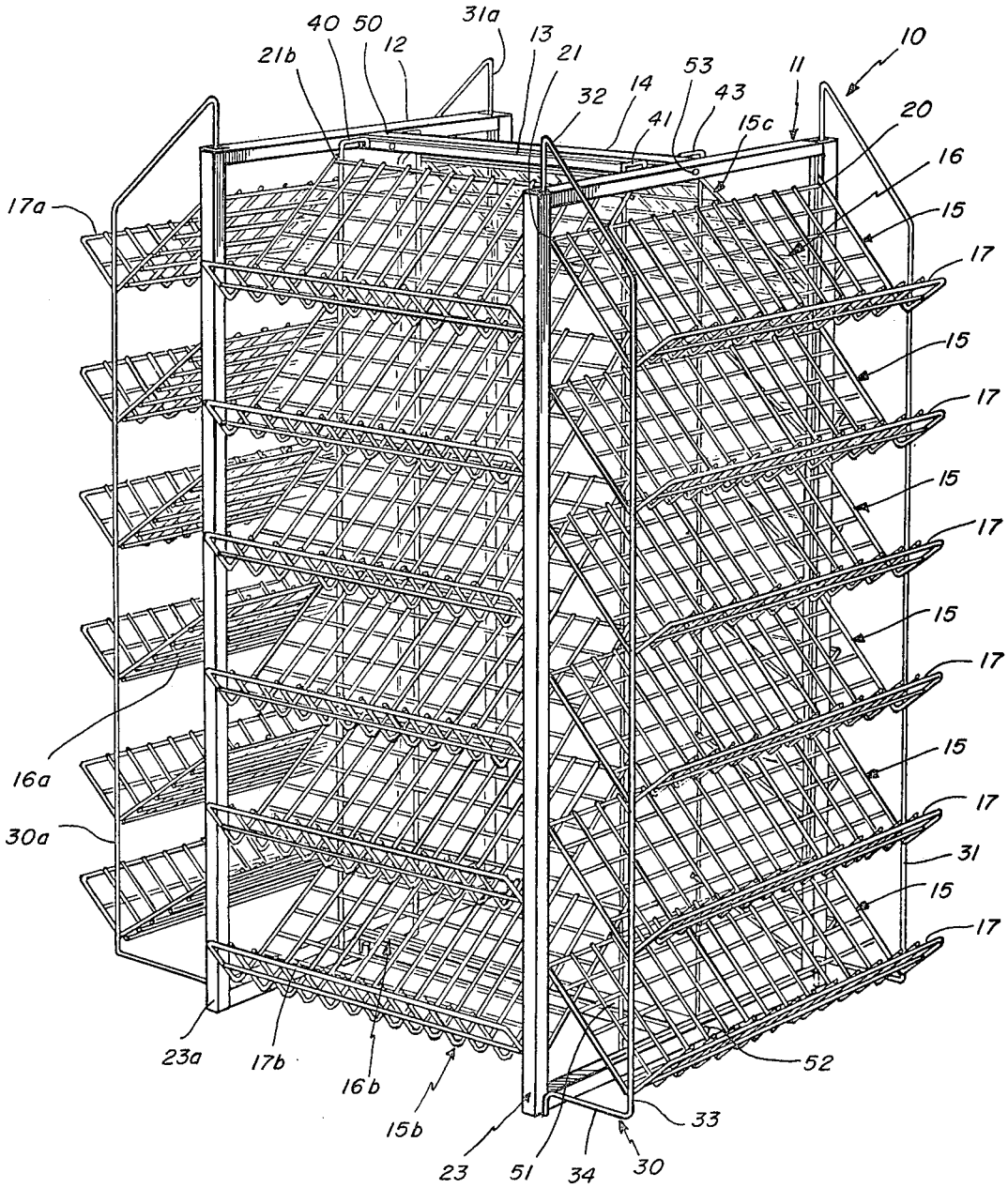
FIG. 1 is a front perspective view of a preferred embodiment of a placemat rack of this invention.
Figure 2:
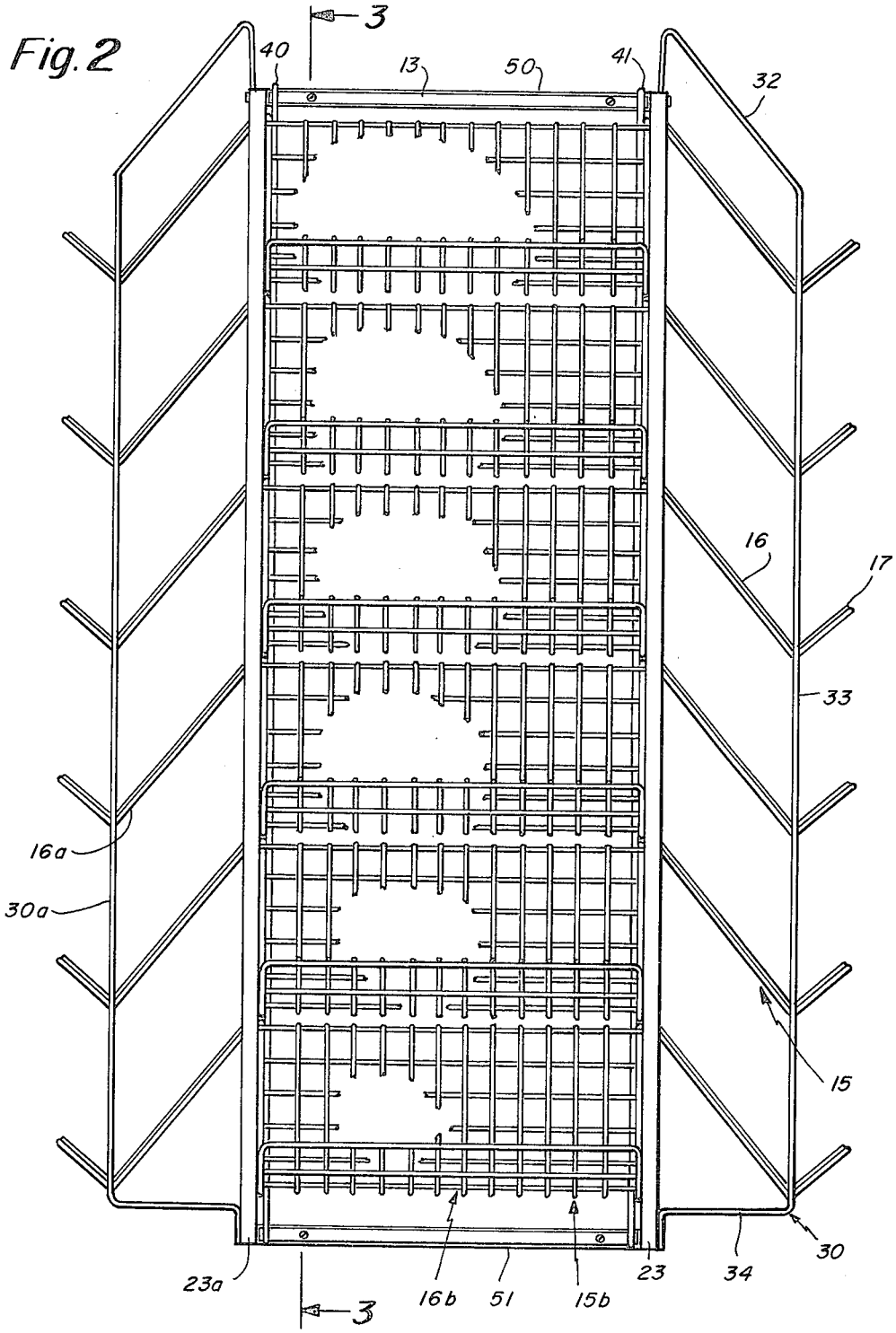
FIG. 2 is a left side view thereof with the right side view not shown, being substantially identical.

With reference now to the drawings, a placemat rack in accordance with a preferred embodiment of this invention is shown generally at 10 and has a first front section 11 and opposed rear section 12 identical to the front section, a left side section 13 and an opposed substantially parallel right side section 14 with all the sections arranged so as to maximize conservation of floor space. The sections comprise a plurality of wire shelves such as 15 which are substantially identical in all of the sections.

Section 11 which is identical to section 12 has six wire shelves 15 aligned in a vertically extending row from top to bottom of the display rack. Each shelf 15 is adapted to hold a plurality of placemats and preferably at least six. In the preferred embodiment, eighteen are held in each shelf in fully extended position so as to lie flat on a placemat display flat section denoted at 16. The flat section 16 is arranged at an angle to a vertical axis drawn through the center of the display rack and preferably that angle is such as to maximize display area of all the shelves from a front viewing plane parallel to the vertical axis and touching the outer lips 17 of each shelf in a section. The placemats are accessible to the eye of a viewer from the viewing or facing plane drawn through the outer edge of the lips 117 of each section. It is preferred that that viewer see all of the placemats in a particular row of shelves when viewing.

Each shelf 15 has a flat area 16 with an outer upstanding lip 17 at an angle to the plane of the shelf, which angle can be 90° or any other suitable angle, to prevent placemats from falling off the shelf when displayed. Each shelf is preferably made up of wire rack materials as is conventional in the wire rack art. The wires or rods are welded to each other at right angle crossover points as known. Each shelf has an upper inner right-hand corner 20 and an upper inner left-hand corner 21. The corners are welded to an outer rectangular frame 23 formed of channel members arranged at right angles to each other. Thus, spot welds are formed only at the upper inner corners such as 21 and 20 of each shelf with the shelf having a cantilever-type action and with the lip outer end 17 being free. Thus, there is some give to the shelf so that should the hand of a user accidentally bump the outer end of the shelf, the shelf will tend to give somewhat, tending to cause less damage to the hand of a viewer. This structure is not required but adds an additional safety feature to the shelf.

The front and rear sections 11 and 12 have an advertising wire end piece at either side thereof indicated at 30 and 31 Wire 30 which is identical to wire 31 extends upward at a first section on one side of section 11, downward in a second section 32 with a vertical run 33 and a rearward wire run 34 welded to the rectangular frame 23 at the bottom and to an upper portion of the rectangular frame 23 at the top. This wire side piece 30 provides a boundary for the rack and can mount clear plastic sheets bearing advertising material (not shown) if desired.

Since the sections are substantially identical, corresponding members of the sections 11, 12, 13, 14 are designated with the same numbers and in addition for each section, the letters a, b and c, respectively.

Sections 13 and 14 which lie substantially back to back to each other have their shelves **15*b* and 15*c*, respectively, mounted on upstanding wire rods 40 and 41, 42 and 43. Wire rod 40 is welded to the upper corner 21*b* of each shelf and similarly rod 41 is welded to an upper corner 20*b* of each shelf in its section to provide the cantilever-type action previously discussed. The rods 40 and 41 have bent over ends 44 and 45 which are bolted by upper and lower bolts 46 and 47 to their corresponding opposed rods 42 and 43, respectively, using wing nut holders 48 and 49. The bolts 46 and 47 pass through preformed holes in the ends of the rods and are mounted on a square cross section cross piece 50 at the upper top of the rack and a square cross section cross piece 51** at the bottom of the rack.

Figure 3:
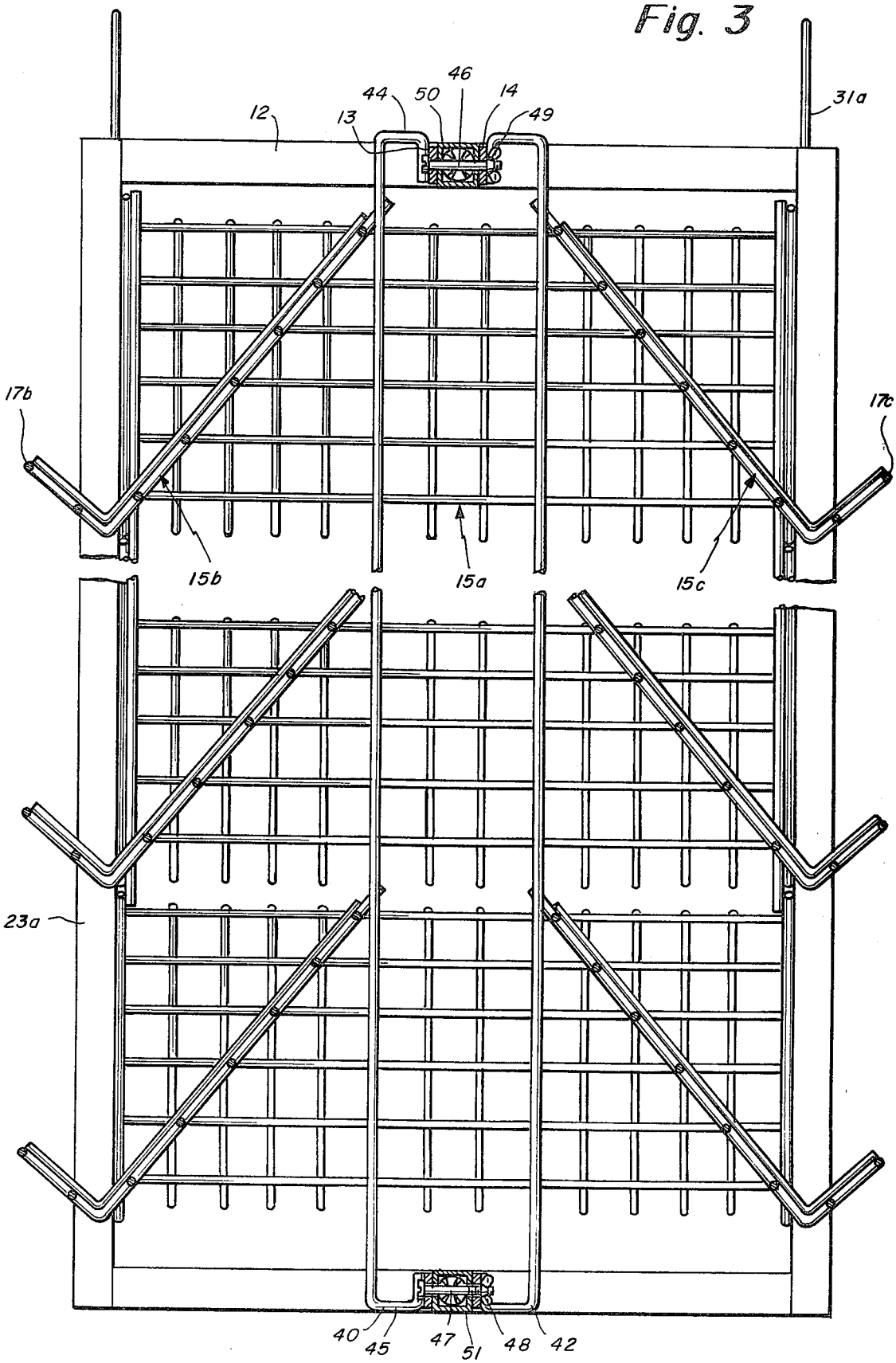
FIG. 3 is a cross sectional view taken through line 3—3 of FIG. 2.

Cross pieces 50 and 51 are enclosed channel members as best seen in FIG. 3 and are parallel to each other and perpendicular to frames 23 and **23*a*. The cross pieces can be made of the same channel members as are the four sections of each frame 23 which make up such frames. The cross pieces 50 and 51 are mounted to the frames 23 and 23*a* preferably by Heliarc nuts of conventional type shown at 52 and 53**.

In assembly of the device, sections 13 and 14 are preferably first assembled by bolting to the cross bars 50 and 51 in back to back relationship to form parallel viewing planes at the faces of each section which planes are opposed to each other. The cross pieces 40 and 41 are then joined to the frames 23 and **23*a* by a screw means or other fasteners as known in the art so that sections 11 and 12 are in back to back spaced apart relationship perpendicular to sections 11 and 12 and again provide parallel opposed viewing or facing planes passing through the lips 17** thereof.

Figure 4:
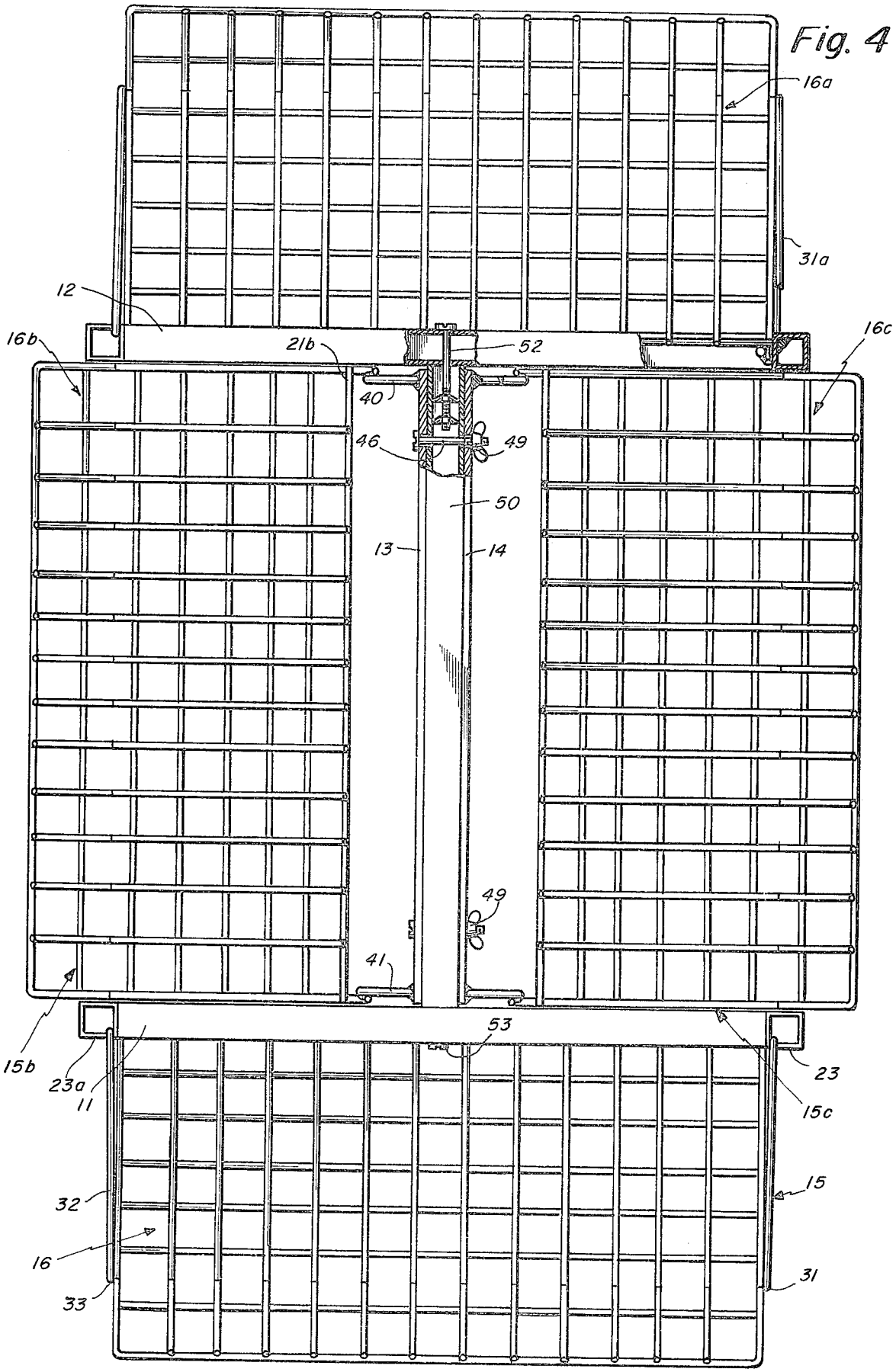
FIG. 4 is a top plan view of the placement rack of this invention.

A top view as shown in FIG. 4 clearly indicates that the viewing area available to the public for the placemats substantially fills the cross sectional area taken on a horizontal plane through the placemat rack. Thus, utilization of space is maximized. The placemats lying flat on each shelf provide best display and are more apt to result in greater sales because of greater visibility to a viewer.

In the preferred embodiment, the rack 10 has an overall height of about six feet and has a substantially rectangular configuration in a horizontal plane with each shelf having a side to side dimension of 24" and a front to back dimension of 12 inches. Thus, the peripheral floor area occupied by the rack is a rectangle of approximately 24 inches by 48 inches. Each shelf preferably has an angle to a vertical axis through the center of the rack of about 45°. This provides placement of about eighteen placemats on each shelf with six shelves on each side of the preferred embodiment. The shelves have a length of at least 16 inches and a front to back width of at least 10 inches in order to allow flat display of an entire placemat.

While a specific embodiment has been shown and described, many variations are possible. While the wire rack preferably has wires arranged at right angles to each other, spot welded together at crossover points and at the rear joint to the frame, other conventional wire rack constructions could be used as is known to those skilled in the art. Preferably, the advertising rods 30 and 31 are used although they could be eliminated in some embodiments. While the rods are not attached to the shelf fronts, in some cases they could be so attached.

The shelves while six in number in the preferred embodiment can vary and the vertical array can have three or more shelves up to ten in normal usage. Preferably, the flat or substantially flat displaying area of each shelf has an area of at least ten inches by at least eighteen inches to provide for proper display of placemats in a flat condition. While the angle of the shelf to the vertical is preferably 45°, this can vary and depends in part on the height between the shelves which in the preferred embodiment is about 13½ inches. In all cases, it is preferred that one shelf not substantially overlie a second shelf when viewed from the front viewing plane so as to provide maximized display area.

While channel member frames are preferred, other metallic or wood frame mountings can be used with desired attachment means as known in the art.

What is claimed is:

1. A placemat rack for maximizing esthetically pleasing display of a large number of placemats in a minimized floor area, said rack comprising a first wire section defining a series of placemat shelves for holding a placemat in extended unfolded position for viewing along a first facing plane, each of said shelves being arranged at an angle to a vertical axis of said rack and slanting downward from the back to the front of said first section with the shelves being stacked in a vertical row and providing a plurality of side to side extending display area each having a side to side length of at least 16 inches and a front to back width of at least 10 inches, an upwardly extending lip at an outer portion of each of said shelves for supporting edges of said placemats when stacked on said shelves, and a second wire section carrying placemat shelves connected with said first section and providing for placemat display and viewing along a second facing plane different from said first plane, said first and second wire sections defining an outer perimeter within which substantially all of said area is covered by placemats when viewed from the top of said rack, said placemat shelves of said second section being arranged at an angle to a vertical axis of said rack and slant downwardly from the back to the front of the second section with the shelves being stacked in a vertical row and providing a plurality of side to side extending display areas each having a side to side length of at least 16 inches and a front to back width of at least 10 inches with an upwardly extending lip and outer portion of each of said shelves supporting edges of said placemats when stacked on said shelves, said second wire section and said first wire section each having a mounting frame and being in back to back spaced apart relationship with each other, and third and fourth wire sections each having shelf arrangements identical to said shelf arrangements of said first and second wire sections with said third and fourth wire sections lying in back to back relationship with each other and spanning substantially the entire space between said spaced apart first and second sections to provide four viewing planes about the periphery of said placemat rack, a plurality of said shelves being mounted in a cantilever manner to leave lip ends thereof substantially free, said first and second sections each having side mounting rods extending from upper to lower portions of said section for mounting of display advertising materials, said first and second sections each being provided with channel frames located in planes parallel to each other, and spanning cross pieces mounting said third and fourth sections with the cross pieces extending substantially perpendicular to said first and second section frames.

2. A placemat rack in accordance with claim 1 wherein said shelves of said first wire section are attached to a mounting frame at rear ends only leaving front ends thereof free.

* * * * *

UNITED STATES PATENT AND TRADEMARK OFFICE

CERTIFICATE OF CORRECTION

PATENT NO. : 4,299,327

DATED : November 10, 1981

INVENTOR(S) : William R. Thauer

It is certified that error appears in the above—identified patent and that said Letters Patent is hereby corrected as shown below:

Column 2, line 52, please change "117" to --17--.

Column 3, line 9, after "31", first occurrence, please insert a period.

Signed and Sealed this

*Ninth* Day of *March 1982*

[SEAL]

*Attest:*

GERALD J. MOSSINGHOFF

*Attesting Officer*

*Commissioner of Patents and Trademarks*